US005375361A

United States Patent [19]

Rustick

[11] Patent Number: 5,375,361

[45] Date of Patent: Dec. 27, 1994

[54] SIGHT MOUNT PROVIDING ADJUSTABLE EYE RELIEF

[76] Inventor: Joseph M. Rustick, 3043 E. Cypress, Phoenix, Ariz. 85008

[21] Appl. No.: 96,596

[22] Filed: Jul. 22, 1993

[51] Int. Cl.[5] ..... F41G 1/387

[52] U.S. Cl. ..... 42/101; 33/247; 33/250

[58] Field of Search ..... 42/101, 103, 100; 33/250, 247, 248, 249

[56] References Cited

U.S. PATENT DOCUMENTS

| | | | |
|---|---|---|---|
| 3,877,166 | 4/1975 | Ward | 42/101 |
| 3,945,142 | 3/1976 | Keppeler | 42/100 |
| 4,205,473 | 6/1980 | Wilson | 42/101 |
| 4,959,908 | 10/1990 | Weyrauch | 33/247 |

FOREIGN PATENT DOCUMENTS

| | | | |
|---|---|---|---|
| 274620 | 12/1968 | Australia | 33/250 |
| 266848 | 3/1927 | United Kingdom | 33/250 |

*Primary Examiner*—Stephen M. Johnson
*Attorney, Agent, or Firm*—Joseph H. Roediger

[57] ABSTRACT

A sight mount for interchangeable sighting devices which provides adjustable eye relief and improved stability. The base, affixed to the receiver, is provided with parallel guideways to receive a slide support. Midway on the base is a vertically movable block which frictionally engages the slide support to lock it into position at the desired distance from the eye. A separate slide support is used for each scope for ease of interchange.

17 Claims, 3 Drawing Sheets

SIGHT MOUNT PROVIDING ADJUSTABLE EYE RELIEF

BACKGROUND OF THE INVENTION

This invention relates to a sight mount for a firearm having the capability of use with a plurality of interchangeable sighting devices.

The precision marksman has come to recognize that variations in range, lighting and weather conditions call for the use of different sights in order to maintain a high degree of accuracy. At a minimum, the dedicated marksman utilizes a day scope and a night scope. As firing conditions demand, the sight is changed requiring a mechanical disassembly of the sight and the sight mount followed by a reassembly and attachment of the replacement sight. In order to achieve accuracy, the newly mounted sighting device is subjected to a number of adjustments. These may include not only a resighting of the device but also a repositioning of the sight support on the firearm to achieve the desired spacing between the sight and the eye of the marksman. Further, the problem of sight misalignment occurs not only from activity at the time of changing sights but also during normal use as a result of insecure sight mounts.

A wide number of different sight mounts have been used with varying results. For example, the use of scope rings which surround the firearm barrel and the generally cylindrical telescopic sight have been used. In U.S. Pat. No. 4,835,895 to Bowen, a ring system for mounting on a barrel using spaced rings is shown. The use of spaced supports renders the device susceptible to misalignment if the sight is to be replaced in the rings. Replacement of the rings requires resighting. Furthermore, barrel mounts result in long eye relief since the sighting device is mounted well away from the aiming eye.

One alternative to the use of spaced rings is seen in U.S. Pat. No. 4,845,871 wherein a fixed base is attached to the firearm and a slidable support is held in position by use of cam locks. The use of cam surfaces in precision sighting is not favored due to the sensitivity of the device. At the long distances involved, any slight variations in alignment are greatly magnified in the target area. A second alternative to the barrel mounted ring approach is shown in U.S. Pat. No. 4,021,954 to Crawford wherein the sight mount utilizes a single clamping device which surrounds the barrel. Guideways are provided in the clamping device for receiving an intermediate adapter. The sight or scope is positioned in the adapter and held by clamping bolts. The adapter can be released from a fixed position. This permits axial adjustment and enables the sight to be replaced by the steps of releasing the clamping bolts, performing the replacement or adjustment and then retightening the assembly. There are several distinct operations performed with clamping devices, each of which has the potential to alter the accuracy of the sight. In summary, the device is cumbersome and requires several steps to change the eye relief for the scope.

For the most part, mounts for sighting devices are designed for use with particular types or models of firearms. As a result, a large number of sight mounts exist to accommodate the different fixed sighting devices and the need to locate the mounting device so that it does not interfere with the ejection of cartridges. In U.S. Pat. No. 4,941,277 to Lawlor, a sight mount for attachment to the fixed rib on a barrel is disclosed. The device utilizes a plurality of clamping bolts to urge the open ends of an extrusion into engagement with the rib. The top of the extrusion is provided with a guideway dimensioned to fit the guideway of a particular scope. The device disclosed appears limited in its application to a particular sight geometry.

The importance of providing for the use of multiple scopes in a single mount is recognized in the two sight mount shown in U.S. Pat. No. 5,134,798. This device establishes a difference in elevation between sight positions to permit mounting of two scopes on a single mount. The eye relief for the two scopes is fixed at different distances which is a distinct disadvantage to the marksman.

Accordingly, the present invention is directed to the provision of mounting device having ease of interchangeability to permit use of replacement scopes without disassembling of the device. Furthermore, the eye relief between scope and the aiming eye can be readily adjusted in the subject invention without requiring the use of tools. In addition, the invention secures the scope or sighting device to the mount with a single securing element and facilitates interchangeability of sights without requiring resighting or other mechanical adjustment. The use of a single securing element essentially eliminates misalignment due to torsional or other forces applied to the mount during normal use.

SUMMARY OF THE INVENTION

The invention provides a sight mount for receiving one of a plurality of interchangeable sighting devices such as telescopic sights, laser targeting sights, infrared sensing sights and the like.

The present mount utilizes an elongated base member which is dimensioned for placement on and affixation to the top surface of a firearm. The mount has an upper surface with spaced raised platforms thereon which are preferably formed as a single unit with the base member. The raised platforms form guideways to movably receive a slide support having the sighting device previously affixed thereto.

A moving block is positioned in the intermediate region between the first and second platforms. The opposing edges of the moving block are in substantial alignment with the first and second guideways with the alignment therebetween varying based on the vertical position of the moving block. The moving block is coupled to a means for imparting vertical movement to the block to thereby change the relative alignment between guideways and opposing edges. The position of misalignment with the block elevated allows the slide support to move along the guideways. When the position of the moving block is changed, the opposing edges are brought into alignment and frictionally engage the slide support to fix its position on the base member.

The procedure is reversed to free the slide support for movement along the base member. As a result, the distance to the aiming eye can be readily changed. In addition, the slide support and attached sighting device can be removed from the base member. A replacement sighting device affixed to another slide support can then be inserted into the guideways and moved along the base member to the desired position. Vertical movement of the block then fixes the position of the replacement sight and no further adjustment is necessary to resume use of the firearm.

The elongated base member of the sight mount is provided with a recess beneath the moving block to accommodate a lever arm which permits easy release of the moving block when locked in the engaged position. An enlargement of the recess at the side of the base member prevents the invention from unduly interfering with ejected cartridges as they leave the receiver section of the firearm.

Further features and advantages of the invention will become more readily apparent from the following detailed description of the invention when taken in conjunction with the accompanying drawings.

DESCRIPTION OF THE PREFERRED EMBODIMENT

Figure 1:
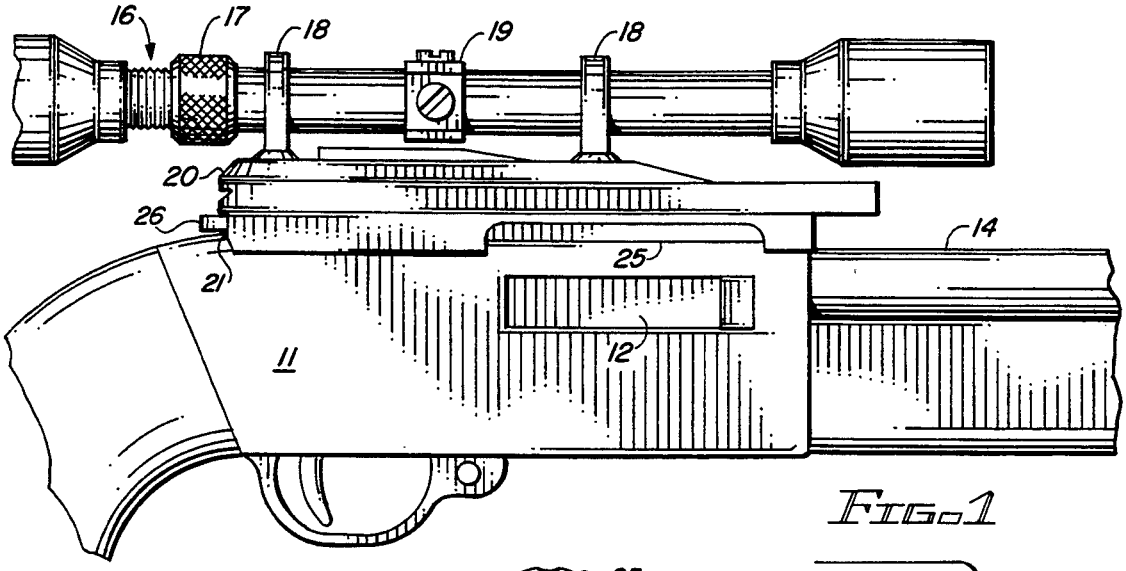
FIG. 1 is a partial side view of the present invention shown attached to the receiver of a firearm.

Referring now to FIG. 1, a firearm is shown having the subject sight mount generally comprised of elongated base member 21 and slide support 20 thereon attached to the receiver section 11. The sight mount is positioned above the port 12 in the receiver section. The barrel 14 extends outwardly from the receiver section and is only partially shown. While this embodiment is shown attached to the receiver, it is to be noted that it can be located on the barrel if desired.

A typical telescopic sight 16 is shown affixed to the slide support 20 by standard ring clamps 18. These ring clamps are each fastened normally by a single threaded fastener frown the underside of the slide support and are not released during a changeover between sights. The telescopic sight is provided with a typical adjustable focus eyepiece and locking nut 17 and an internal adjustment section 19. The screws in adjustment section 19 are normally used to center the reticle within the sight. Elevational compensation can be provided by the use of this adjustment when the scope is to be used for targets within a particular range. The particular sight shown is used only for purposes of explanation and it is to be understood that a variety of different sighting devices can be used with the present invention.

Figure 2:
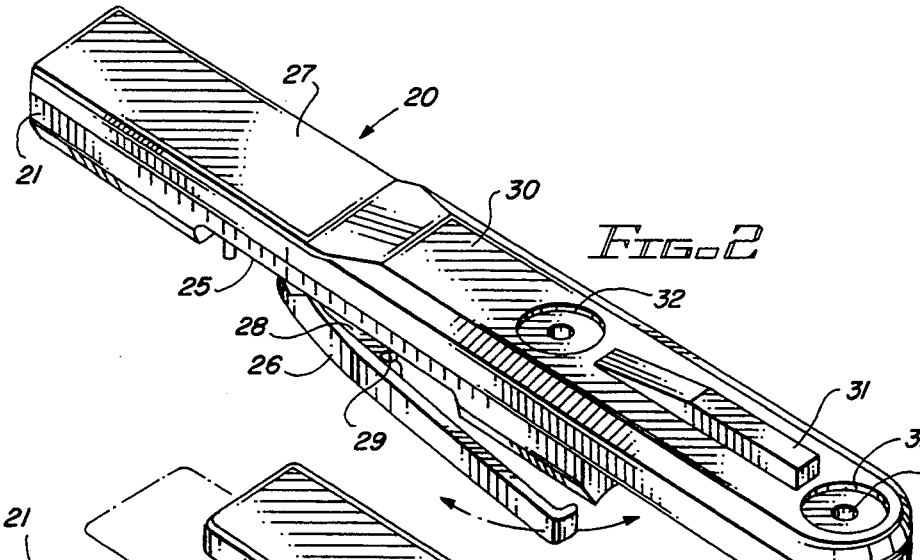
FIG. 2 is a view in perspective of the present sight mount removed from the firearm and without the scope.

In the position shown in FIGS. 1 and 2, the slide 20 has its central index 22 centered in the calibration scale of the base member 21. By permitting movement of the slide support 20 in relation to the base member 21, the eye relief or distance between the eyepiece of the sight 16 and the aiming eye of the user can be varied. The calibrations and central index 22 are not related to distance to any given target, but are provided to allow the user to quickly replace sights and corresponding slide support and maintain the same eye relief. The recess 25 formed in the base of the sight mount 15 accommodates lever arm 26 as shown in FIG. 2. The recess is generally aligned in overlying relationship to the port 12 of the receiver. In the preferred embodiment, recess 25 is enlarged at the side opposite the lever arm so that the sight mount is not encountered by the cartridge ejected from port 12. In operation, the ability of the sight mount to remain clear of the normal trajectory of ejected cartridges is an important feature of the invention.

The embodiment of FIG. 1 with the sight 16 removed is shown more clearly in the perspective view of FIG. 2 wherein the sight mount is removed from the firearm. The top surface of slide support 20 is shown comprising a flat section 27 and a pedestal 30. The section 27 accommodates the large diameter lenspiece of the sight 16. In practice, the height of clamps 18 determines the spacing necessary for a particular sight and are selected accordingly. The recesses 32 are each provided with a central opening to permit the fastening of the base of clamps 18 from the bottom of the side support. The installation of the clamps and associated sight is normally performed once with a separate slide mount being attached to each of the different sighting devices available to the marksman.

Figure 3:
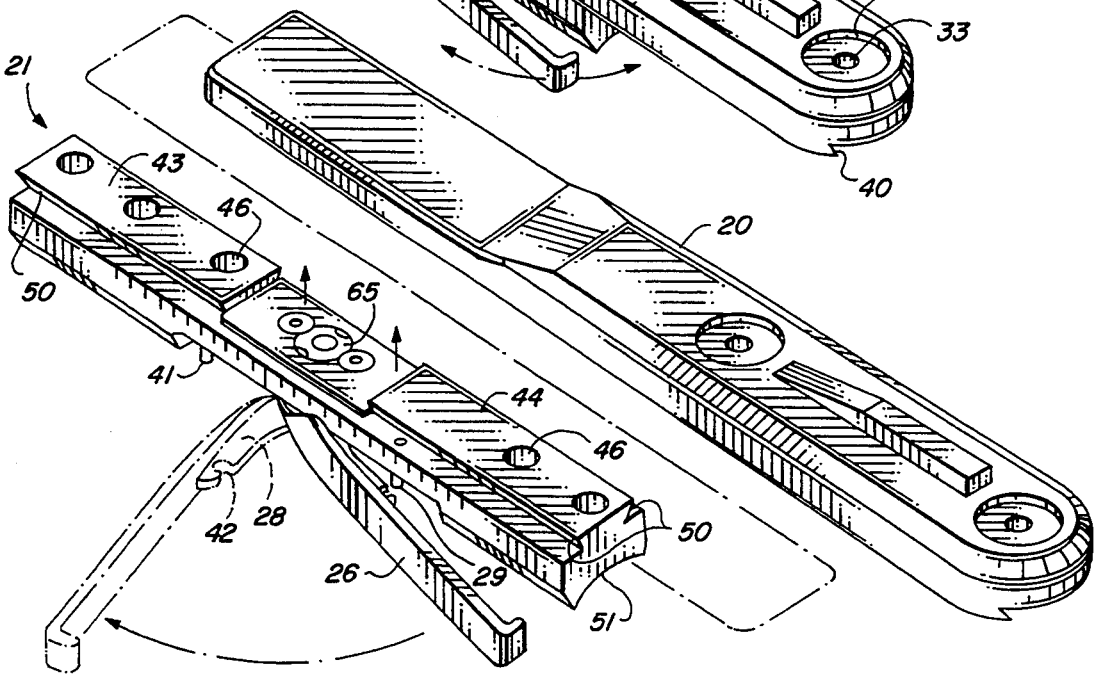
FIG. 3 is a perspective view of the embodiment of FIG. 2 with the base member and slide support separated.

As shown in FIGS. 2 and 3, the lever arm 26 is partially withdrawn from its locked position against base 21 with movement permitted in the direction of the arrows. This frees the notch in web 28 from the locking pin 29 and permits relative movement between base 21 and slide support 20. Movement is governed by the dovetail guideway 40 formed in the slide support 20. The guideway extends longitudinally along the slide support.

Figure 4:
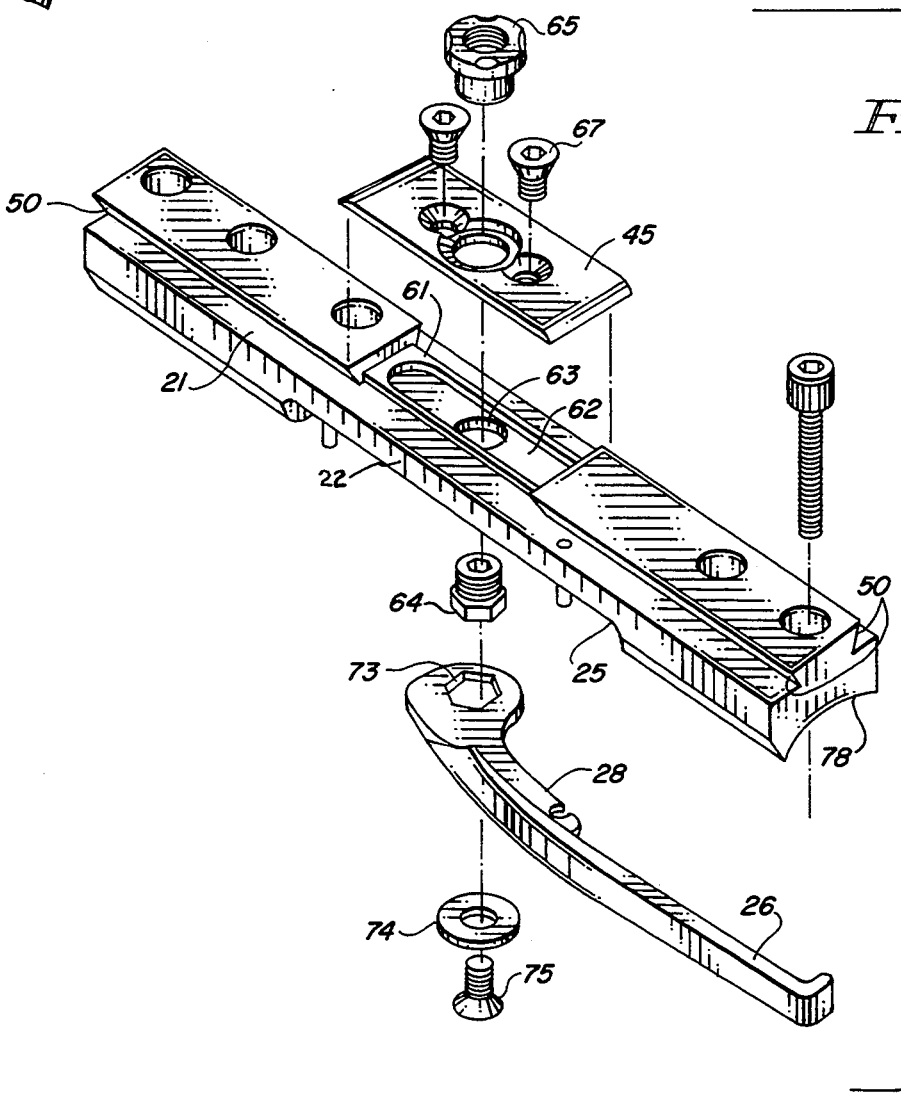
FIG. 4 is an exploded view showing the base member of FIG. 3.

The slide support 20 is shown removed from the elongated base member 21 in the exploded view of FIG. 3. The lever arm 26 is opened slightly further and is shown by the dash line in its fully opened position. When it is closed, the notch 42 in web 28 engages the locking pin 29 formed in the underlying recess 25 of the base member. The limit pill 41 is provided to prevent the lever arm from being driven back against the base member and eliminating a potential source of damage. As shown, the base member has on its upper surface first and second raised platforms 43 and 44. Each of the raised platforms is provided with holes 46 which extend through the basal member and enable the member 21 to be affixed to the receiver of the firearm. The location of the holes 46 is determined by the type and model of firearm with which the invention is to be used and may either align with existing openings or additional holes call be drilled to receive suitable fastening means as shown in FIG. 4. A moving block 45 is shown positioned between the first and second raised platforms. The vertical position of the moving block is determined by the position of the lever arm and determines when relative movement between base and slide support can take place. The arrows in FIG. 3 show the direction of movement of the block.

The first and second raised platforms 43, 44 each contain guideways 50 formed in the opposing longitudinal surfaces. The slide support 20 rests on the surface of the base member and is guided by the inwardly tapered side surfaces of the raised platforms which form the guideways 50. As mentioned previously, the dovetail guideway 40 of the slide support 20 extends uniformly along the bottom surface of the slide support. Travel of the slide support along the base member is not impeded if the moving block is vertically raised to be out of alignment with the guideways 50. The opposing longitudinal edges of the moving block 45 have inward tapers which move downwardly to conform to the guideways 50 when the handle 26 is being closed. When the handle is open, the slide support can be readily removed from its position as shown in FIG. 2. As the handle 26 is closed and the notch 42 of web 28 engages the locking pin 29, the vertical position of the moving block 45 is changed. This causes the opposing side edges of moving block 45 to become aligned with the guideways 50 (which determine the position of the dovetail guideway 40 of the slide support) so that the moving block fictionally engages guideway 40 and the slide support is fixed in position. The preferred embodiment utilizes both sides of the block 45 to engage the slide support 20 and equalize the forces on each side of the block.

The constructional features of the base member 21 are shown in FIG. 4 wherein the moving block 45 and its interconnection with lever arm 26 are shown in exploded format. The first and second platforms 43, 44 are shown with the inwardly tapered sides forming the guideways 50 extending longitudinally along with base member. In between the platforms is a raised section 61 having a cutout portion 62 into which the base of the moving block is received when the block is lowered. A central opening 63 extends through to recess 25 to accommodate the coupling means between the arm 26 and the moving block 45. The moving block contains a vertical opening 63 for the rotational coupler 64 which extends upwardly through support 20.

Figure 5:
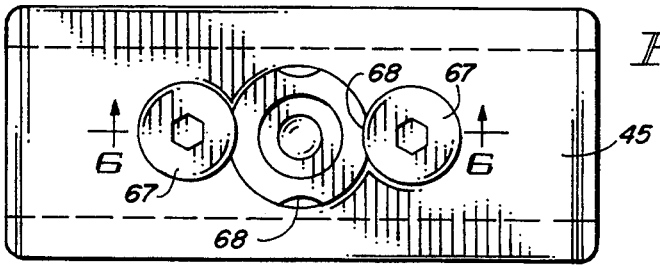
FIG. 5 is a plan view of the moving block of the preferred embodiment.
Figure 7:
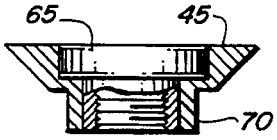
FIG. 7 is a view in section taken along line 7—7 of FIG. 6.
Figure 6:
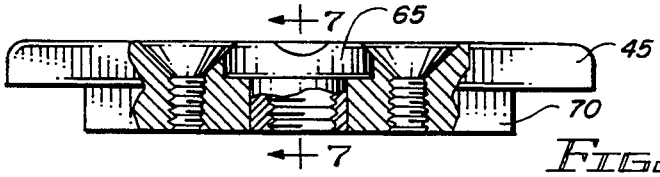
FIG. 6 is a view in section taken along line 6—6 of FIG. 5.

The moving block is shown in further detail in FIGS. 5 and 6 wherein the mating threads for the rotational coupler 64 are contained in the internally threaded member 65. As shown, member 65 is seated in the moving block 45 wherein a recess is provided for its head. The rotational coupler 64 is threaded into cylindrical member 65 through the underside of the moving block via opening 63. When the cylindrical member 65 is positioned in the block 45, the position screws 67 are threaded into adjacent receiving holes. It is to be noted that the cylindrical member 65 has a plurality of notches 68 spaced about its periphery which receive the beveled heads of the two position screws. The adjacent position screws are aligned so as to rest securely in opposing notches to prevent rotation of member 65 with respect to the moving block 45. The locations of the position screws and the threaded member 65 in block 45 is shown in FIGS. 5 and 6. The cross sectional view of FIG. 7 shows the cylindrical member 65 as it rests in position in the block 45. In addition, the inwardly tapered opposing sides of the block and the relationship to the downward extension 70 of the block is seen in FIGS. 6 and 7.

During the course of manufacture, the cylindrical member 65 and the position screws are inserted in the moving block 45 and the assemblage is then placed in the central cutout portion 62. The rotational coupler 64 is then threaded into the member 65 from the bottom of the base member. The handle 28 is secured to the hexagonal head of the rotational coupler by the combination of beveled washer 74 and threaded fastener 75. The threaded fastener 75 is received in internal threads of the rotational coupler. As a result, movement of the arm 28 is translated into rotation of the coupler 64. The rotation of coupler 64 causes member 65 to move along the external threads of coupler 64 thereby imparting vertical movement to the moving block 45. By this manner, the alignment between the opposing edges of the moving block and the guideways 50 can be varied from complete alignment against the slide support to misalignment and thus permit movement therebetween.

Figure 8:
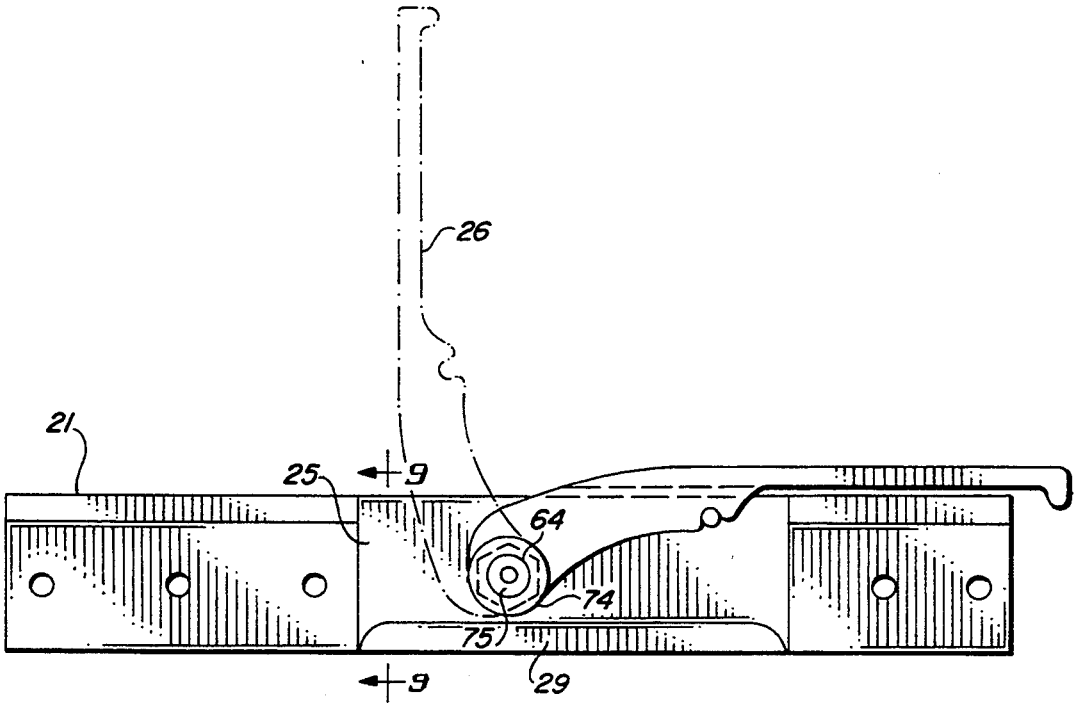
FIG. 8 is a bottom plan view of the base member of FIG. 3.
Figure 9:
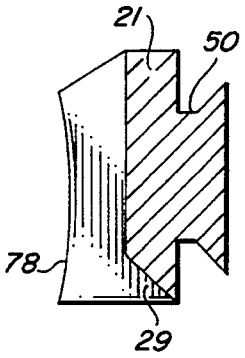
FIG. 9 is a cross section of the base member.

The recess 25 formed in the base member is shown in the bottom view, of FIG. 8 and enables the handle 26 and the web 28 containing hexagonal opening 73 to be received in the base member without interfering with the attachment to the receiver of the firearm. In addition, the side region 29 of recess 25 located away from the lever arm is further cut away to provide an enlarged opening as shown in FIG. 9 to prevent interference with ejected cartridges. In the preferred embodiment, the base is provided with a curved lower surface 78 shown in FIG. 9 to permit conformance to the contour of the receiver. The curved surface 78 extends along the length of the base member on each side of the recess 25. Since the crone causes the base member to extend downwardly on the receiver towards the port 12, the enlarged region 29 of recess 25 provides clearance between the sight mounting device and the trajectory of ejected cartridges. Thus, the positioning of the device on the receiver does not interfere with normal operation of the firearm.

The normal operating position of the invention is shown in FIG. 1. When the marksman wishes to remove the present sight 16, the arm 26 is moved outwardly to cause the frictional engagement of the moving block with the slide support to be released. The opposing side edges of the moving block are then out of general alignment with the guideways and the slide support and affixed sight is removed. The replacement sight and its slide support are then inserted into the guideways and moved to the position corresponding to the prior location of index 23 for the same eye relief. The arm 26 is then urged into the closed position wherein notch 42 engages the locking pin 29. The moving block is urged into alignment by the rotational coupler 64 so that the opposing side edges fictionally engage the guideway 40 of the new slide support. Thus. interchangeability of sighting devices can be readily affected by movement of a single lever arm. No mechanical operation requiring tools are required and the need for follow up resighting is eliminated.

While the above description has referred to a preferred embodiment of the invention, it is to be noted that modifications and variations may be made therein without departing from the scope of the invention as claimed.

I claim:

1. A sight mount for attachment to a firearm and receiving a slide support having a sighting device affixed thereto, said mount comprising:

a) an elongated base member having upper and lower surfaces, said lower surface containing a recess formed therein:

b) a raised platform located on the upper surface of the elongated member, said platform including opposing sidewalls;

c) first and second guideways formed in the opposing sidewalls of said platform to receive said slide support;

d) a block sited on the upper surface of the elongated base member, said block having opposing side surfaces positioned in substantial alignment with said first and second guideways; and e) a coupler positioned in the recess formed in the lower surface of said base member, said coupler movably attaching the block to the base member, actuation of said coupler varying alignment between said first and second guideways and said opposing side surfaces of the block whereby said block frictionally engages said slide support.

2. The invention in accordance with claim 1 wherein the raised platform includes first and second raised platforms affixed to the upper surface of the elongated member, said first and second platforms being spaced to receive the movable block therebetween.

3. The invention in accordance with claim 2 wherein said coupler is mounted for rotation in the base member.

4. The invention in accordance with claim 3 wherein said guideways and said side surfaces are inwardly tapered.

5. The invention in accordance with claim 4 wherein said base member includes a centrally located threaded member for receiving said coupler therein.

6. The invention in accordance with claim 5 further comprising a lever arm attached to the coupler for imparting rotation thereto.

7. The invention in accordance with claim 6 wherein said coupler is a threaded member.

8. A sight mount for receiving one of a plurality of interchangeable sighting devices mounted on a slide support, said mount comprising:

a) an elongated member having upper and lower surfaces;

b) first and second raised platforms located on the upper surface of the elongated member and spaced to provide an intermediate region therebetween;

c) first and second guideways formed in said raised platforms to receive said slide support;

d) a moving block positioned in the intermediate region between the first and second platforms, said block having first and second opposing edges in substantial alignment with said first and second guideways; and e) means for imparting vertical movement to the moving block to modify the alignment between the guideways and the opposing edges of the moving block and fictionally engage said slide support.

9. The invention in accordance with claim 8 further comprising said slide support, said slide support having an upper sighting surface and a lower positioning surface, said positioning surface slidably engaging the first and second guideways and the first and second opposing edges, the actuation of the means for imparting vertical movement causing the moving block to engage said slide support and fix the position thereof on the elongated member.

10. The invention in accordance with claim 9 wherein said means for imparting vertical movement comprises a first threaded member extending upwardly from the lower surface of the elongated member into mating threads located in the moving block, and means for imparting rotation to said threaded member.

11. The invention in accordance with claim 10 wherein said means for imparting rotation to said threaded member includes a lever arm extending outwardly from the lower surface of the elongated member.

12. The invention in accordance with claim 11 further comprising a recess formed in the lower surface of the elongated member for receiving the lever arm.

13. The invention in accordance with claim 12 further comprising a hollow cylindrical member having an internal surface, said mating threads being formed in said internal surface, said cylindrical member being inserted into the moving block for engagement by the first threaded member.

14. The invention in accordance with claim 13 wherein the cylindrical member includes a head having at least one notch therein, and further comprising means for insertion into the moving block in alignment with said notch for limiting rotation of the cylindrical member.

15. The invention in accordance with claim 12 further comprising an engaging pin contained in said recess for maintaining the lever arm in a closed position.

16. The invention in accordance with claim 15 further comprising a limit pin contained in said recess for limiting movement of the lever arm.

17. The invention in accordance with claim 16 further comprising a plurality of openings formed in the raised platforms for receiving fasteners to affix the mount to the receiver.

* * * * *